US005924902A

United States Patent [19]

Burns et al.

[11] Patent Number: 5,924,902

[45] Date of Patent: Jul. 20, 1999

[54] AMPHIBIOUS SWIMMING AND WALKING SHOE

[75] Inventors: Terrence R. Burns, Snyder; John C. Zoll, Rushford, both of N.Y.

[73] Assignee: Hollywood Hopefuls Production, Inc., Snyder, N.Y.

[21] Appl. No.: 09/150,718

[22] Filed: Sep. 10, 1998

Related U.S. Application Data

[60] Provisional application No. 60/070,571, Jan. 6, 1998.

[51] Int. Cl.[6] ..... A63B 31/08

[52] U.S. Cl. ..... 441/64

[58] Field of Search ..... 441/61, 62, 63, 441/64; D21/239

[56] References Cited

U.S. PATENT DOCUMENTS

| | | | |
|---|---|---|---|
| 1,059,565 | 4/1913 | Robinson . | |
| 4,657,515 | 4/1987 | Ciccotelli | 441/64 |
| 4,752,259 | 6/1988 | Tackett et al. | 441/64 |
| 4,981,454 | 1/1991 | Klein | 441/62 |
| 5,108,327 | 4/1992 | Klein | 441/64 |
| 5,292,272 | 3/1994 | Grim | 441/64 |
| 5,447,457 | 9/1995 | Kamitani | 441/64 |
| 5,595,518 | 1/1997 | Ours | 441/64 |

*Primary Examiner*—Stephen Avila

*Attorney, Agent, or Firm*—Marianne Fuierer; Howard M. Ellis

[57] ABSTRACT

Amphibious shoes which may be used as walking shoes with easy convertibility to swim fins. The amphibious shoes of the present invention comprise a shoe-like structure and a one-piece continuous sole-fin structure affixed to the shoe-like structure. The one-piece continuous sole-fin structure comprises a fin-like extension integrally fused to a sole portion of the shoe-like structure and a flexible folding zone, thereby facilitating the easy movement of the fin-like extension for engaging with the shoe-like structure. The fin-like extension folds upward and is secured to the shoe-like structure in the walking mode and unfolds with minimal manipulation for swimming without the need for mechanical pivoting or locking devices. The fin-like extension has a length not exceeding the distance to the user's ankle when secured in the walking mode thereby allowing for unencumbered walking but still providing ample surface area for increased propulsion during swimming.

20 Claims, 5 Drawing Sheets

AMPHIBIOUS SWIMMING AND WALKING SHOE

CROSS REFERENCE TO RELATED APPLICATION

This application claims the benefit of U.S. Provisional Application Ser. No. 60/070,571 filed Jan. 6, 1998.

TECHNICAL FIELD

The present invention relates in general to multifunctional swimming shoes and in particular to amphibious shoes which may be used as walking shoes with easy convertibility to swim fins.

BACKGROUND OF THE INVENTION

Swim fins are devices that substantially increase the surface area of the naked foot thereby increasing the propulsive force of the legs. If used properly swim fins can conserve a diver's energy and facilitate underwater movement by becoming powerful extensions of a diver's body. In fact, fins can be so effective that arms and hands are not necessarily needed for propulsion when skin or scuba diving. However, few things feel as awkward as trying to walk while wearing swim fins due to the extended length of the fins which are cumbersome and can be potentially dangerous while walking.

To overcome this problem various swim fins have been proposed which provide a more natural and safer ambulatory motion. This is achieved by removing the blade portion from the front of the swim-fin. However, many of these proposals include complex pivoting devices and/or locking mechanisms that may corrode or malfunction during use. For example, U.S. Pat. No. 5,292,272 (Grim) discloses an open-heel swim fin having a pivoting fin which when retracted permits the fin blade to be positioned at a 90° angle to the longitudinal axis of the foot. The fin blade pivots directly at the toe of the foot pocket, yet walking is still difficult because the upright blade increases resistance when walking or wading in shallow water. Likewise, U.S. Pat. No. 4,981,454 (Klein) discloses an open-heel swim fin having a retractable fin blade that pivots near the arch of the 10 foot. This pivoting allows for the fin to rise above the instep of the foot and positioned adjacent and parallel to the leg.

This prevents an awkward upright blade at the toe of the foot pocket but the fin blade is still in a cumbersome position which reduces flexibility when walking. U.S. Pat. No. 4,752,259 (Tackett et al.) discloses another embodiment of an open-heel model having a retractable fin wherein the surface area of the fin blade is bifurcated. The frontal end portion of the fin blade pivots upon itself either over or under the foot to facilitate walking. However, only a portion of the blade retracts leaving a substantial length of the fin blade extending longitudinally beyond the user's foot which impedes natural ambulation.

Accordingly, there is a need for a more reliable amphibious swim shoe that can be worn comfortably on land or wading in shallow water and can be easily converted into a swim fin without the disadvantages of complicated pivoting mechanisms, reduced flexibility of movement or malfunctioning locking mechanisms.

SUMMARY OF INVENTION

Generally, the present invention relates to a multifunctional convertible amphibious shoe which can be used for ambulating on land and shallow water while protecting the foot from sharp objects. With minimal manipulation, the improved amphibious shoe may be converted into swimming mode by unfolding a flexible fin blade for additional propulsive mobility during swimming, snorkeling or scuba diving.

For purposes of this invention, the terms and expressions below appearing in the specification and claims are intended to have the following meanings:

"Sole" the undersurface of the shoe-like structure exposed directly to water during swimming mode and land during ambulating mode.

"Integrally fused" as used herein means the fin-like extension is connected to the sole portion of the shoe-like structure forming a one-piece continuous sole-fin structure without reliance on mechanical attachment means such as hinges, pivoting devices and the like.

Accordingly, it is a principal object of the present invention to provide improved multi-functional amphibious shoes which can function as walking shoes when ambulating and readily convert to swim fins for swimming mode. The amphibious shoe comprises a shoe-like structure and a one-piece continuous sole-fin structure affixed to the shoe-like structure. The one-piece continuous sole-fin structure comprises a fin-like extension integrally fused to a sole portion of the shoe-like structure and a flexible folding zone thereby facilitating the easy movement of the fin-like extension for engaging with the shoe-like structure. The fin-like extension folds upward and is secured to the shoe-like structure in the walking mode and unfolds with minimal manipulation for swimming without the need for mechanical pivoting or locking devices.

The above object is achieved principally through an amphibious shoe applicable for both swimming and walking comprising:

a shoe-like structure having a toe portion, heel portion, instep portion and bottom portion interconnected to form a foot receiving cavity;

a sole portion adjacent and affixed to the bottom portion of the shoe-like structure;

a one-piece continuous sole-fin structure attached to the shoe-like structure, the one-piece continuous sole-fin structure comprising i) a fin-like extension integrally fused to the sole portion, the fin-like extension projecting axially beyond the toe portion;

ii) a flexible folding zone adjacent to the toe portion thereby allowing the fin-like extension to fold and engage with the instep portion of the shoe-like structure; and a means for fastening the fin-like extension to the instep portion of the shoe-like structure.

Dimensionally, the fin-like extension blade is approximately the length of the instep portion of the shoe-like structure and not exceeding a length that contacts a user's ankle when engaging with the instep portion of the shoe-like structure thereby avoiding contact with the shin portion of the leg when secured in the walking mode.

In another preferred embodiment the amphibious swimming and walking shoe comprises:

a shoe-like structure having a toe portion, heel portion, instep portion and sole portion interconnected to form a foot receiving cavity;

a one-piece continuous sole-fin structure affixed to the shoe-like structure, the one-piece continuous sole-fin structure comprising i) a fin-like extension integrally fused to the sole portion, the fin-like extension projecting axially beyond the toe portion of the shoe-like structure a distance approximating that of the instep portion of the shoe structure;

ii) a flexible folding zone adjacent to the toe portion thereby allowing the fin-like extension to fold and engage with the instep portion of the shoe-like structure; and a means for fastening the fin-like extension to the instep portion of the shoe-like structure when in a folded position.

BRIEF DESCRIPTION OF THE DRAWINGS

The particular features and advantages of the invention as well as other objects will become apparent from the following accompanying drawings in which.

DESCRIPTION OF THE PREFERRED EMBODIMENT

Figure 1:
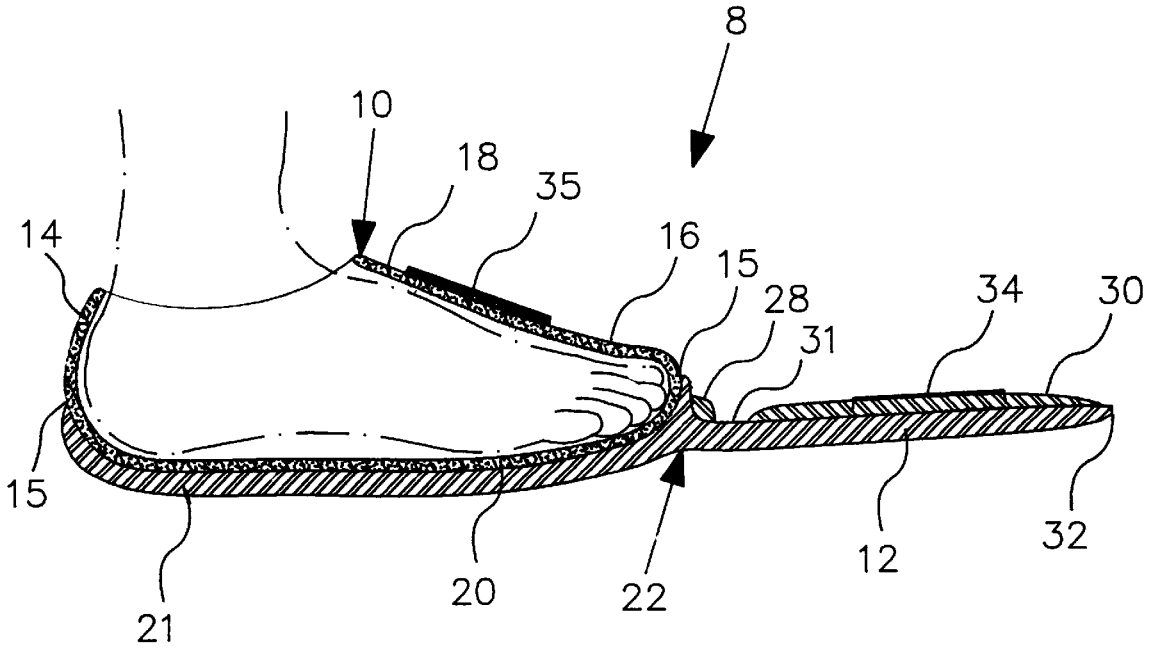
FIG. 1 is a side elevational sectional view of one embodiment of a convertible amphibious swimming and walking shoe of the present invention.

Referring now to the drawings, FIG. 1 illustrates an amphibious walking and swimming shoe 8 of the present invention having a protective shoe-like structure 10 for encasing the foot and a fin-like extension 12 extending thereof. The shoe-like structure 10 comprises a protective heel portion 14, an instep portion 18, a frontal toe portion 16, a full bottom portion 20. Shoe-like structure 10 may be fabricated as a one-piece composite structure and constructed of any flexible material having the characteristic of easily stretching over the foot forming a snug, but comfortable fit. Preferably, the flexible material includes neoprene rubber and any other natural or synthetic elastomeric materials. The fit of the shoe-like structure should be tight enough so there is no sliding on the foot, but at the same time not so snug as to impede circulation and cause cramping. The size of the amphibious swimming and walking shoe should be selected as a good pair of shoes because a properly adjusted fit eliminates chances of chafing and blistering.

The fin-like extension 12 projects axially beyond the toe portion 16 of the shoe-like structure 10 and is integrally fused to sole portion 21 thereby forming a one-piece continuous sole-fin structure 22. The bottom portion 20 of the shoe-like structure 10 is adjacent and bonded to the one-piece continuous structure 22 of the amphibious shoe. The shoe-like structure may be affixed to the one-piece continuous sole-fin structure by any adhesive or bonding system that is well known in the art and which forms a permanent bond between the two structures.

The one-piece continuous sole-fin structure may be constructed of any resilient and flexible material that provides sufficient puncture protection from sharp objects yet offers sufficient flexibility for flexing of the fin blade during swimming and folding. This material may include various natural and synthetic rubbers; polymeric material, such as silicone, polyethylene, polyester, polypropylene, polyurethane and so on; thermoplastic or a composite material. In choosing the material the degree of flexibility determines the different styles of fins, such as swimming-style or power-style. Increased flexibility in chosen material reduces leg fatigue while increased rigidity provides for maximum power thrust.

Shoe buoyancy may be considered when selecting an appropriate material for fabricating the amphibious shoe, understanding that this factor does not generally affect the quality or performance of the amphibious shoe. Materials having a density less than one (1) may be considered for increased buoyancy. It is within the purview of a person skilled in the art to pick and choose among the foregoing material groups to achieve a specific result for a particular application.

The one-piece continuous sole-fin structure 22 covers the bottom portion 20 of the shoe-like structure and may rise upward perpendicularly around the shoe-like structure a sufficient distance thereby forming a flange or bumper-like lip 15 which encircles the entire shoe-like structure. This rising bumper-like lip provides additional protection for the foot when encountering rocks, coral or other sharp objects while walking on land or in shallow water.

Figure 2:
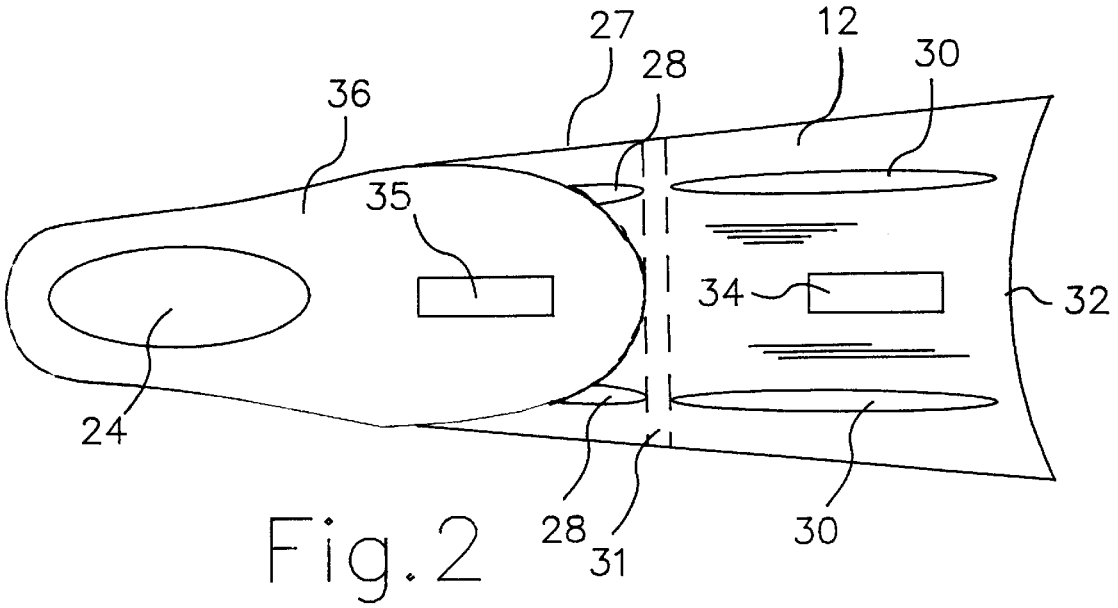
FIG. 2 is a top plan view of the amphibious swimming and walking shoe of FIG. 1 shown with the fin blade in an extended position for swimming.

FIG. 2 shows fin-like extension blade 12 in an extended swimming position, opening 24 for receiving a foot and one preferred embodiment of fin blade 12. Variations of total fin blade surface area, outline or shape, curvature or flexing angle, and rigidity of fin blade ribs to govern their flexibility are combined to provide optimal efficiency of thrust and positive control to the diver. Any fin blade design which optimally directs the flow of water along the fin blade may be used in the present invention. A plurality of ribs may be positioned on the fin blade, formed onto both the upper surface plane and lower surface plane (not shown) for increased strength and support. Preferably, longitudinal ribs are formed on the upper surface plane of fin-like extension 12. First ribs 28 are proximal to toe portion 16 and integral to bumper lip 15. Second ribs 30 are distal from toe portion 16 and extend to the terminus end 32 of fin-like extension 12. First and second ribs 28 and 30 project essentially upward above the plane of the finlike extension and perpendicular to the plane of the fin-like extension. The spacing of the ribs from peripheral edge 27 of the fin blade may be less than the spacing between longitudinal placing of the ribs. As shown in FIG. 1 first ribs 28 extend from the toe of the shoe-like structure wherein the height of the ribs 28 is tapered. Second ribs 30 gradually rise from the upper surface plane of the fin-like extension and extend to terminus end 32 where ribs 30 are tapered to merge into the plane of the blade. The ribs may be formed from the same material used in fabricating the one-piece continuous sole-fin structure or as an alternative formed from a material having an increased rigidity relative to the material used in the constructing the one-piece continuous sole-fin structure Positioned between first and second ribs 28 and 30 as shown in FIG. 2 is a folding zone 31 which is unencumbered by ribbing thereby allowing for easy folding of the fin-like extension 12 to the instep portion of the shoe-like structure. The lack of ribbing provides less rigidity in the folding zone allowing second ribs 30 to readily move towards first ribs 28 without binding. Slight manual force is needed to fold the fin-like extension upward and make contact with the instep of the shoe-like structure.

Figure 3:
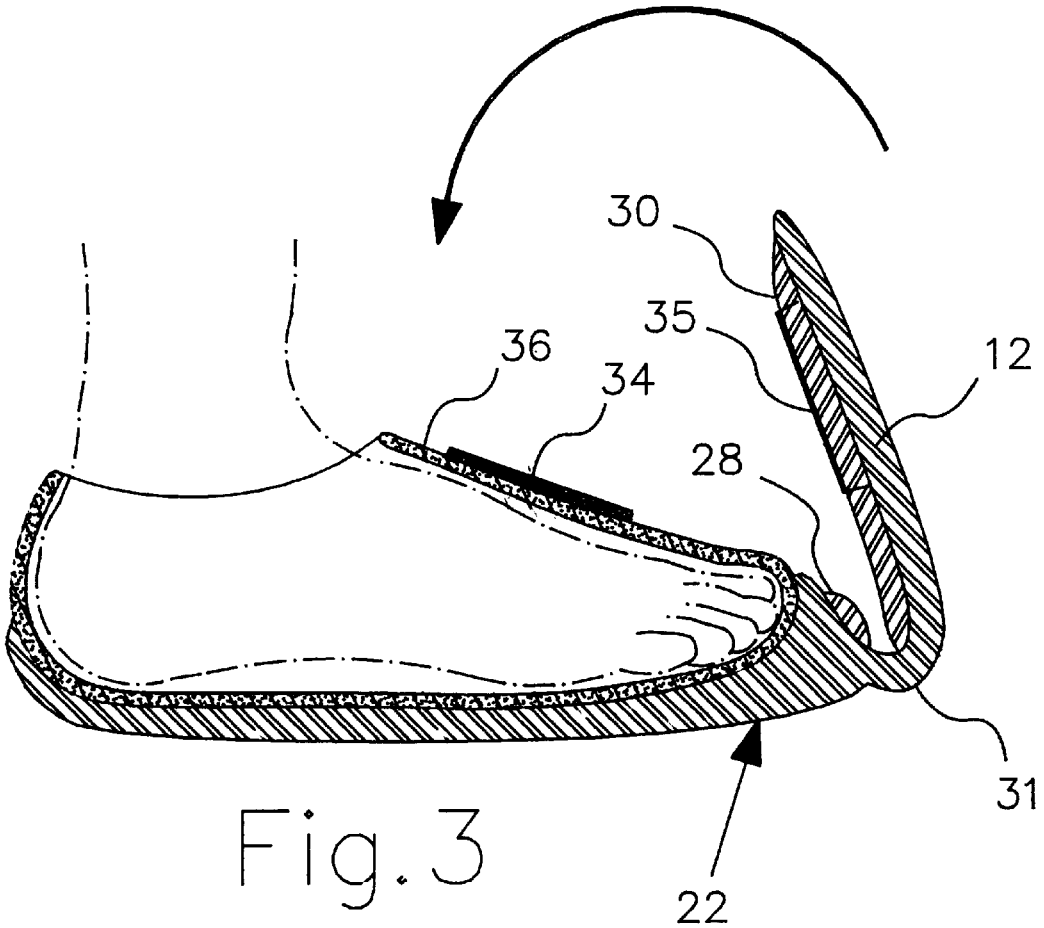
FIG. 3 is a side elevation sectional view of the amphibious swimming and walking shoe of FIG. 1 shown with the fin blade in a partially retracted position.
Figure 4:
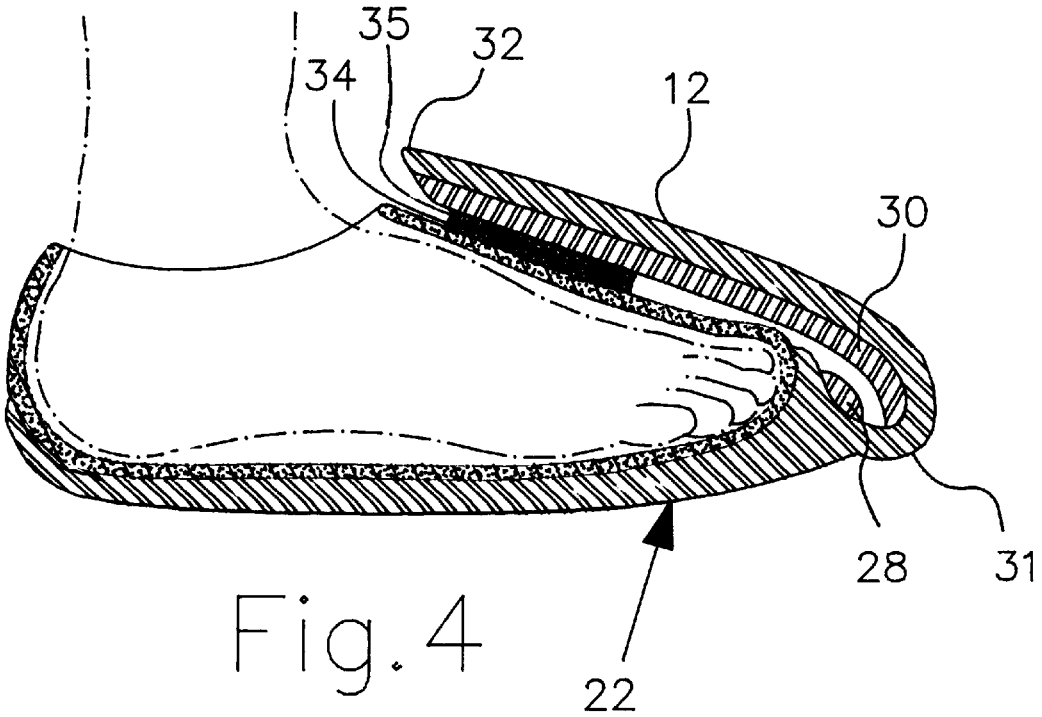
FIG. 4 is a side elevation sectional view of the amphibious swimming and walking shoe of FIG. 1 having the fin blade in a fully retracted position for walking.

In accordance with a preferred embodiment the fin-like extension 12 is in the swimming position as illustrated in FIG. 1 and in the walking position as shown in FIG. 4. Fin-like extension 12 as shown in FIG. 3 and 4 can be folded upward to engage with instep portion 18. Fin-like extension 12 is rotated at an obtuse angle for engagement with instep 18 of the shoe-like structure.

Any suitable means for attachment may be used to securely connect fin-like extension 12 to instep portion 18 when converting the shoe from swimming mode to walking mode. Preferably, as shown in FIG. 2, at least one band of conjugate hooked fabric 34 of the Velcro® type can be attached longitudinally onto the upper side of fin blade 12 to engage with a complement band of conjugate hooked fabric 35 on instep portion 18 to securely affix the fin blade onto the outer surface of the instep portion of the amphibious shoe. At least one band of engaged conjugate hooked fabric provides a secure fastening of the fin blade while providing ample flexibility for walking. Other means of fastening may include snaps, clips, ties or any other conventional fastening means.

The amphibious shoe can be made in graduated sizes to fit all sizes of feet and the length of the fin blade should be proportional to the respective size of the amphibious shoe. Preferably, the length of the fin blade should be approximately the length of the user's instep when the fin blade is positioned in walking mode, as best illustrated by FIG. 4. The terminus end of the fin-like extension should be a distance from the toe portion of the shoe-like structure not exceeding that length which contacts a user's ankle when the fin-like extension engages with the shoe-like structure. This preferred length allows for easy and unencumbered walking without reducing flexibility of ankle movement.

Figure 5:
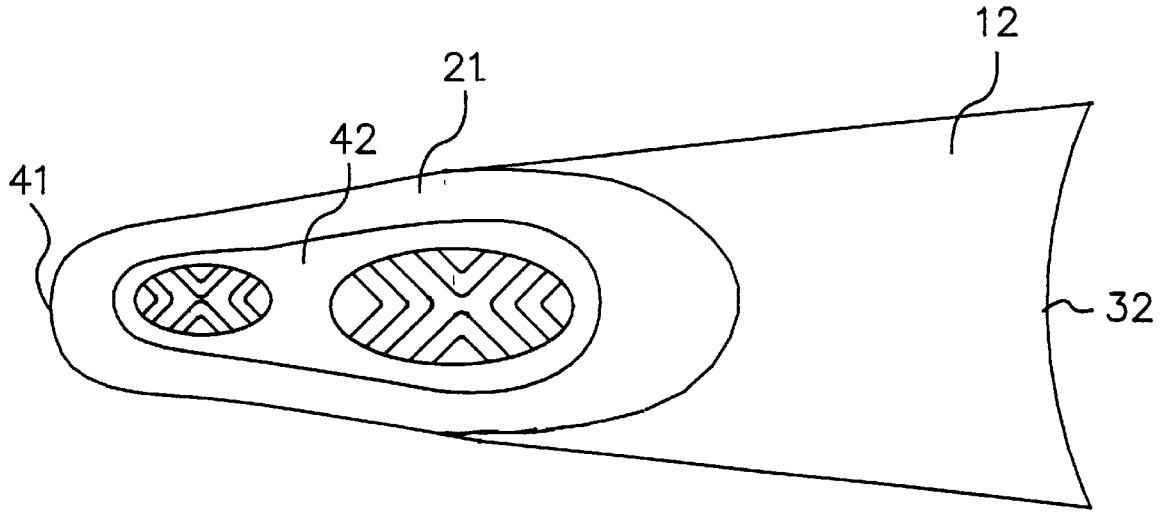
FIG. 5 is a bottom plan view of the amphibious swimming and walking shoe of FIG. 1 illustrating the lower surface plane of the one-piece continuous structure extending from the sole of the shoe-like structure to the fin blade.

FIG. 5 is a bottom plan view of FIG. 1 illustrating the one-piece continuous sole-fin structure 22 extending from heel end 41 to the terminus end 32 of fin-like extension 12. Footprint sole may include a grid pattern 42 to provide better traction in the walking mode when fin-like extension 12 is folded in the walking position. The tread of grid pattern 42 will prevent slippage when walking on wet boat decks, docks or slippery rocks. Although not shown, first and second ribs 28 and 30 as shown in FIG. 2 may be formed on the bottom surface plane for additional redirecting of water flow over the fin blade.

Figure 6:
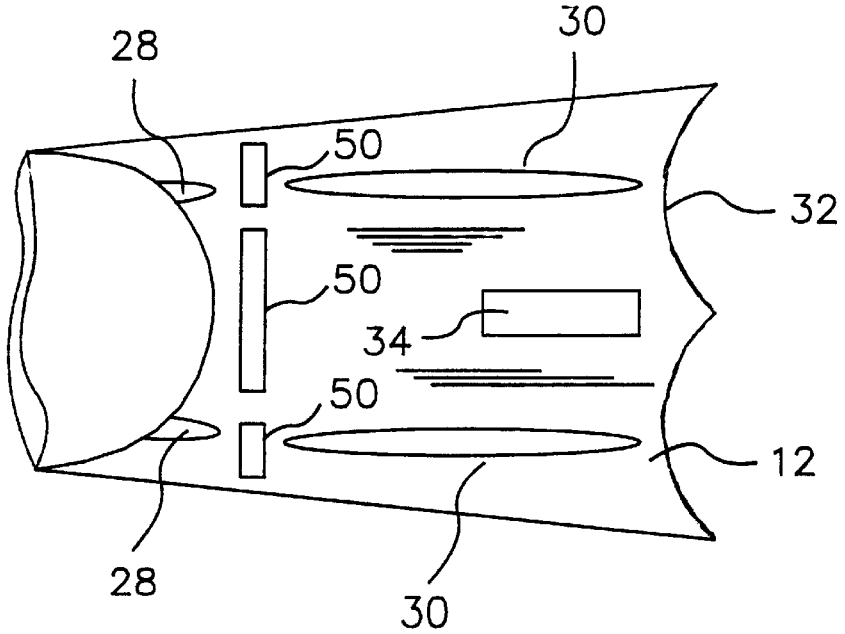
FIG. 6 is a top plan view of FIG. 1 illustrating an alternative fin blade design.

The present invention envisions several different fin designs which generate propulsion in different ways. For example, FIG. 6 shows a vented fin blade design which has open slots or vents 50, positioned perpendicular to the longitudinal axis of the amphibious shoe. The open slots or vents redirect the flow of water through and along the fin. The vents or slots reduce the drag caused by the fin blade surface near the toe portion of the shoe-like structure during blade angle reversal at the end of each stroke. Also, placement of the vents between first ribs 28 and second ribs 30 provides additional flexibility at the approximate folding zone of the fin-like extension when securing the upper plane of the fin-like extension to the instep portion of the amphibious shoe. The terminus end 32 of fin-like extension 12 may take several different shapes to gain maximum thrust and efficiency in the water including a double concave arch as illustrated.

Figure 7:
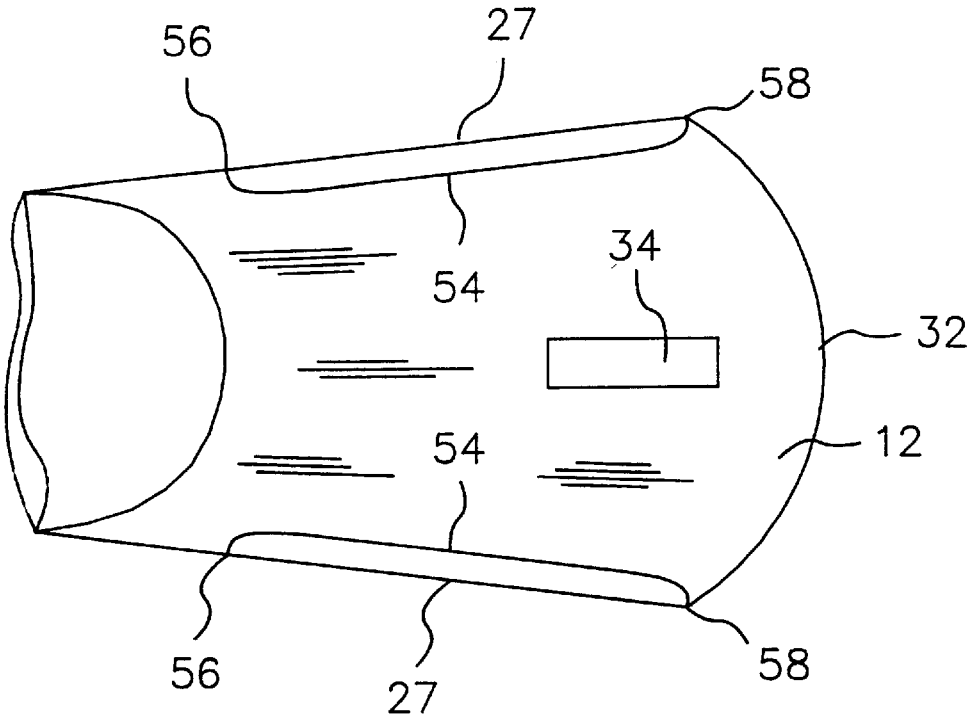
FIG. 7 is a top plan view of FIG. 1 illustrating a further alternative fin blade design.

FIG. 7 shows a fin blade design comprising a single convex arch at terminus end 32 of fin-like extension 12. A plurality of ribs may be positioned on the fin blade for increased strength and/or additional support. Preferably, two longitudinal ribs 54 in the form of elevations on the upper surface plane of fin-like extension 12 may be positioned on the peripheral edges 27 of fin-like extension 12.

Figure 8:
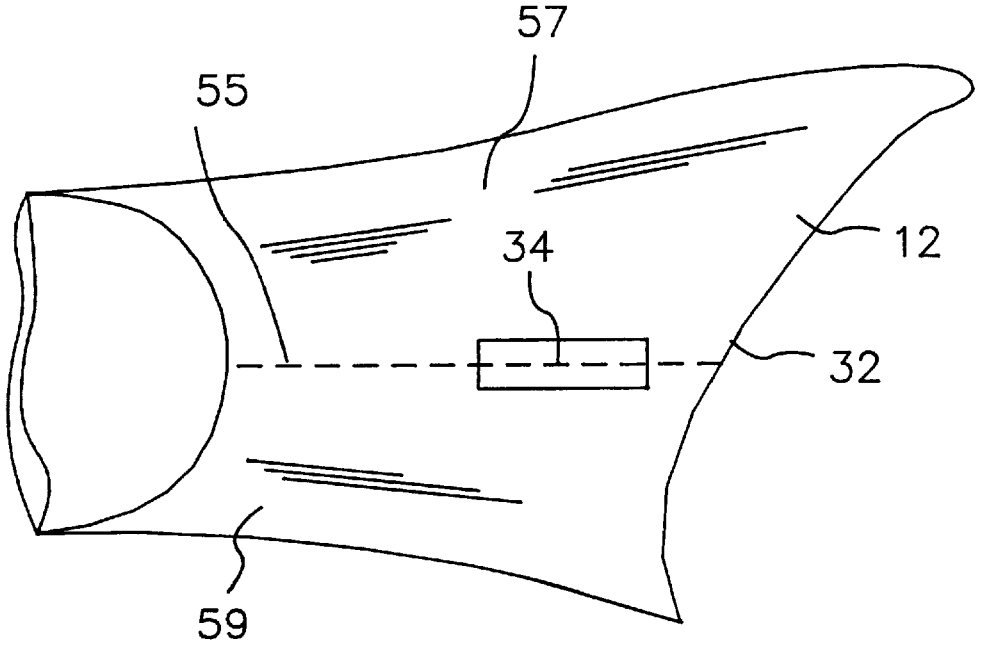
FIG. 8 is a top plan view of FIG. 1 illustrating still a further alternative fin blade design.

FIG. 8 illustrates a caudal or tail fin blade that offers greater surface area, but still accommodates the folding of fin-like extension 12 onto the instep portion of the amphibious shoe. As stated earlier, the length of the fin blade preferably approximates the length of the instep portion of shoe-like structure 10 for maximizing comfort when the amphibious shoe is worn in ambulating mode. FIG. 8 illustrates a fin blade design, specific for a left foot, showing a design that may increase the overall surface area of the fin-like extension. Fin-like extension 12 is divided along line 55 into first and second sections 57 and 59, respectively. The overall surface area of the blade can be increased by lengthening the fin blade on the first section 57 of the fin blade which corresponds to the lateral side of the respective enclosed left foot in the shoe-like structure (not shown). By extending only the first section 57 of the fin blade the second section 59 which corresponds to the medial side of the enclosed left foot maintains the appropriate length for engaging with the instep of the amphibious shoe. In the folding process the first section extension 57 is placed along the lateral side of the left foot and extends beyond the ankle. This placement accommodates the additional length on one side of the fin-like extension and eliminates any impedance in walking. The fin blade design for the right foot (not shown) would be the mirror image of that illustrated in FIG. 8.

Figure 9:
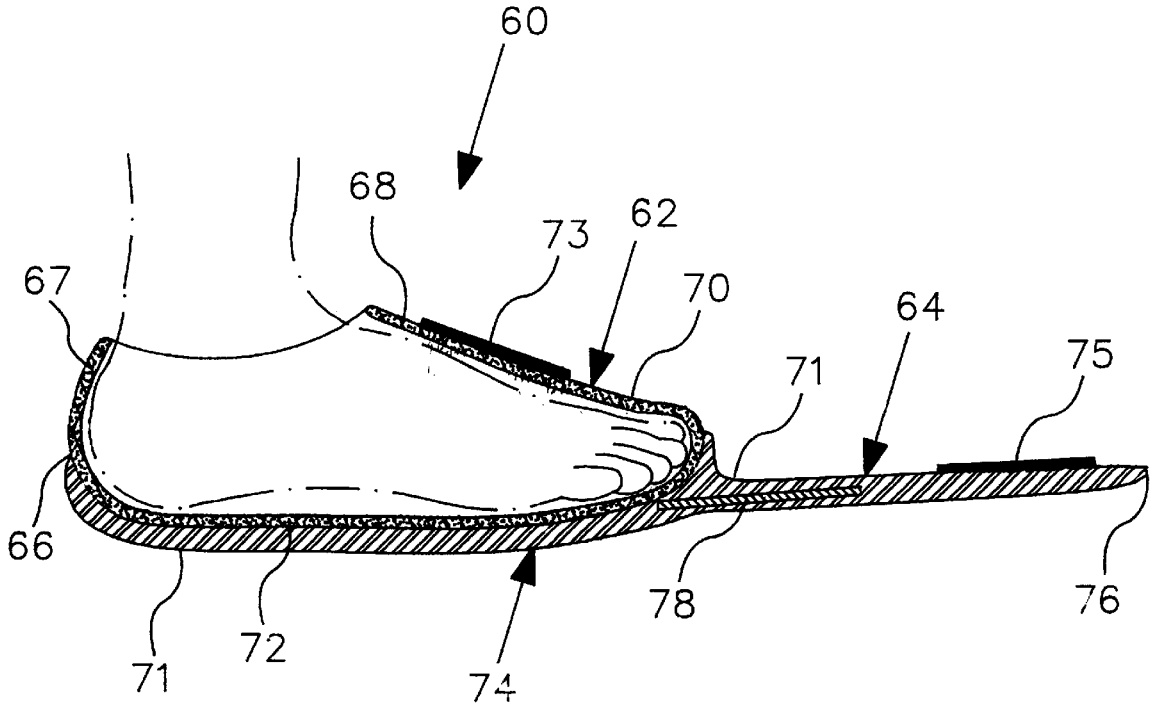
FIG. 9 is a is a side elevational sectional view of an alternate embodiment of the amphibious swimming and walking shoe illustrating the introduction of a shape memory insert.

FIG. 9 illustrates an alternate embodiment of an amphibious shoe having a material insert with memory retention embedded into the one-piece continuous sole-fin structure. The amphibious shoe 60 of the present invention comprises a shoe-like structure 62 and a one-piece continuous sole-fin structure 74. The shoe-like structure 60 comprises a protective heel portion 67 for retaining the shoe on the foot, an instep portion 68, a frontal toe portion 70, a full bottom portion 72 and may be fabricated as a one-piece composite structure. The shoe-like structure can be constructed of a any flexible material having the characteristic of easily stretching over the foot forming a snug but comfortable fit. Representative examples for the shoe-like structure include the flexible material mentioned earlier.

A fin-like extension 64 projects axially beyond the toe portion 70 of the shoe-like structure 62 and is integrally fused to sole portion 71 thereby forming the one-piece continuous sole-fin structure 74. The bottom portion 72 of the shoe-like structure 62 is adjacent and bonded to the one-piece continuous sole-fin structure 74 of the amphibious shoe. The one-piece continuous sole-fin structure may be constructed from any flexible material. Representative examples include the flexible material mentioned earlier.

The one-piece continuous sole-fin structure encloses the bottom portion 72 of the shoe-like structure and rises upward forming a lip 66 to encompass the heel and toe portions of the shoe and encircles the entire shoe-like structure.

An insert 78 comprising a memory retention material is positioned within the one-piece continuous structure beneath toe portion 70 of the shoe-like structure, encompassing folding zone 71 and projecting into the fin-like extension 64. Insert 78 may be fabricated from any material having shape memory and superelastic properties, such as the material known as Nitinol. Nitinol is the common name for a Nickel Titanium alloy commercially available through ordinary channels of commerce. It is a unique material known as a shape memory alloy. This unique alloy shows a superelastic behavior having a very springy, "rubberlike" elasticity which is capable of being deformed, but because of its memory characteristics resists permanent deformation and reverts back to its original shape. The insert 78 is positioned parallel to the longitudinal axis of fin-like extension 64. The insert may be in the form of a plurality of narrow strips, springs, wires or a broad band extending across the width of the fin blade. The memory retention insert is preferably positioned to encompass folding zoning 71 so that when fin-like extension 64 is released from the ambulating mode it repositions itself for swimming mode.

Any suitable means for attachment may be used to securely connect fin-like extension 64 to instep portion 68 in converting the shoe from swimming mode to walking mode. Preferably, at least one band of conjugate hooked fabric 75 of the Velcro® type is attached longitudinally along the fin-like extension 64 to engage with a complement band of conjugate hooked fabric 73 on instep portion 68 to securely affix the fin blade onto the instep of the amphibious shoe. Other means of fastening may include snaps, clips, ties or any other conventional fastening means. Preferably, the length of the fin blade should approximate the length of the instep portion when the fin blade is positioned in the walking mode.

Figure 10:
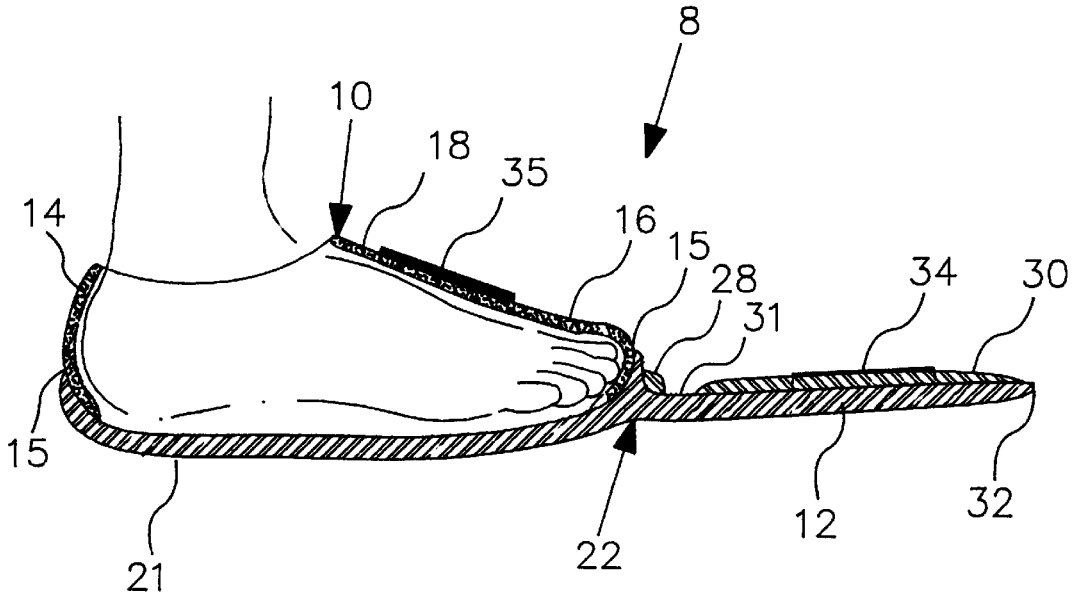
FIG. 10 is a is a side elevational sectional view of an alternate embodiment of a convertible amphibious shoe showing an upper shoe structure attached directly to one-piece continuous sole-fin structure.

FIG. 10 illustrates another embodiment of the amphibious shoes shown in FIG. 1 and FIG. 2 wherein the shoe-like structure comprises the toe, heel and instep portions and these portions are directly affixed to the flexible one-piece continuous sole-fin structure to form the foot receiving cavity. In this embodiment the bottom portion of the shoe structure is removed and the user's foot rests directly on the sole portion of the amphibious shoe. The shoe-like structure may be affixed to the one-piece continuous sole-fin structure by any adhesive or bonding system that is well known in the art and which forms a permanent bond between the two structures.

Numerous alterations of the structure herein disclosed will suggest themselves to those skilled in the art. It is apparent that various changes may be made in the construction and form of the present invention without departing from the spirit and scope of the invention, the forms hereinabove described being merely exemplary embodiments.

What is claimed is:

1. A convertible amphibious shoe for walking and swimming comprising:

a shoe-like structure having at least a sole portion;

a one-piece sole-fin structure attached to said shoe-like structure, said one-piece sole-fin structure comprising i) a fin-like extension projecting axially beyond said shoe-like structure, said fin-like extension integrally fused to said sole portion of said shoe-like structure;

ii) a flexible folding zone for folding of said fin-like extension to engage with said shoe-like structure; and a means for fastening said folded fin-like extension to said shoe-like structure.

2. The convertible amphibious shoe according to claim 1 wherein said fin-like extension having a terminus end positioned a distance from said toe portion not exceeding a length that contacts a user's ankle when engaging with said shoe-like structure.

3. A convertible amphibious shoe for land and water use comprising:

a shoe-like structure having a toe portion, heel portion, instep portion and bottom portion interconnected to form a foot receiving cavity;

a sole portion adjacent and affixed to said bottom portion of said shoe-like structure;

a one-piece sole-fin structure affixed to said shoe-like structure, said one-piece sole-fin structure comprising i) a fin-like extension, said fin-like extension integrally fused to said sole portion and projecting axially beyond said toe portion a distance approximating that of said instep portion of said shoe structure;

ii) a flexible folding zone adjacent to said toe portion thereby allowing said fin-like extension to fold and engage with said instep portion of said shoe-like structure; and a means for fastening said fin-like extension when in a folded position to said instep portion of said shoe-like structure.

4. The convertible amphibious shoe according to claim 3 wherein said fin-like extension has a terminus end positioned a distance from said toe portion not exceeding a length that contacts a user's ankle when engaging with said instep portion of said shoe-like structure.

5. The convertible amphibious shoe according to claim 3 wherein said toe, heel, instep and bottom portion of said shoe structure are fabricated from a member selected from the group consisting of neoprene rubber, a natural elastomeric material and a synthetic elastomeric material.

6. The convertible amphibious shoe according to claim 3 wherein said fin-like extension is secured to said instep portion of said shoe-like structure by a member selected from the group consisting of conjugate hooked fabric, snaps, clips, and ties.

7. The convertible amphibious shoe according to claim 3 wherein said one-piece continuous sole-fin structure is fabricated from a member selected from the group consisting of natural rubber, synthetic rubber, silicone, polyurethane, polyethylene, polypropylene, thermoplastic and composite material.

8. The convertible amphibious shoe according to claim 4 wherein said fin-like extension further comprises a plurality of ribs positioned longitudinally from said toe portion to said terminus end of said fin-like extension excepting said flexible folding zone.

9. The convertible amphibious shoe according to claim 8 wherein said fin-like extension further comprises at least one vent in said flexible folding zone, said at least one vent positioned perpendicular to said plurality of ribs.

10. The convertible amphibious shoe according to claim 8 wherein said one-piece continuous sole-fin structure further comprises a shape memory material insert positioned under said toe portion extending into said fin-like extension and encompassing said folding zone.

11. The convertible amphibious shoe according to claim 8 wherein said shape memory material insert is a nickel-titanium alloy.

12. A convertible amphibious shoe for land and water use comprising:

a shoe-like structure having a toe portion, heel portion, instep portion and sole portion interconnected to form a foot receiving cavity;

a one-piece continuous sole-fin structure attached to said shoe-like structure, said one-piece continuous sole-fin structure comprising a fin-like extension integrally fused to said sole portion, said a fin-like extension projecting axially beyond said toe portion of said shoe-like structure a distance approximating that of said instep portion of said shoe-like structure, said one-piece continuous sole-fin structure having a flexible folding zone adjacent to said toe portion thereby allowing said fin-like extension to fold and engage with said instep portion of said shoe-like structure; and a means for fastening said fin-like extension when in a folded position to said instep portion of said shoe-like structure.

13. The convertible amphibious shoe according to claim 12 wherein said fin-like extension has a terminus end positioned a distance from said toe portion not exceeding a length that contacts a user's ankle when engaging with said instep portion of said shoe-like structure.

14. The convertible amphibious shoe according to claim 12 wherein said toe, heel, instep and bottom portion of said shoe structure is fabricated from a member selected from the group consisting of neoprene rubber, a natural elastomeric material and a synthetic elastomeric material.

15. The convertible amphibious shoe according to claim 12 wherein said fin-like extension is secured to said instep portion of said shoe-like structure by a member selected from the group consisting of conjugate hooked fabric, snaps, clips, and ties.

16. The convertible amphibious shoe according to claim 12 wherein said one-piece continuous sole-fin structure is fabricated from a member selected from the group consisting of natural rubber, synthetic rubber, silicone, polyurethane, polyethylene, polypropylene, thermoplastic and composite material.

17. The convertible amphibious shoe according to claim 13 wherein said fin-like extension further comprises a plurality of ribs positioned longitudinally from said toe portion to said terminal end of said fin-like extension excepting said flexible folding zone.

18. The convertible amphibious shoe according to claim 1 wherein said one-piece continuous sole-fin structure further comprises a memory retention material insert positioned under said toe portion extending into said fin-like extension and encompassing said folding zone.

19. The convertible amphibious shoe according to claim 10 wherein said shape memory material insert is in a form selected from a group consisting of a plurality of narrow strips, springs, wires and broad bands.

20. The convertible amphibious shoe according to claim 12 wherein said one-piece continuous sole-fin structure further comprises a memory retention material insert positioned under said toe portion extending into said fin-like extension and encompassing said folding zone, said memory retention material insert is in a form selected from a group consisting of a plurality of narrow strips, springs, wires and a broad band of material.

* * * * *